United States Patent [19]

Jagen

[11] 4,406,509

[45] Sep. 27, 1983

[54] JACK AND PLUG ELECTRICAL ASSEMBLY

[75] Inventor: Paul R. Jagen, Mechanicsburg, Pa.

[73] Assignee: E. I. Du Pont de Nemours & Co., Wilmington, Del.

[21] Appl. No.: 325,024

[22] Filed: Nov. 25, 1981

[51] Int. Cl.[3] ..... H01R 11/20

[52] U.S. Cl. ..... 339/91 R; 179/1 PC; 339/97 P; 339/204

[58] Field of Search ..... 339/91 R; 339/176 MD, 339/176 M, 126, 125, 17 C, 17 LC, 97 R, 97 P, 204, 205; 179/1 PC

[56] References Cited

U.S. PATENT DOCUMENTS

| | | | |
|---|---|---|---|
| 3,850,497 | 11/1974 | Krumreich et al. | 339/126 R |
| 3,860,316 | 1/1975 | Hardesty | 399/91 R |
| 4,193,654 | 3/1980 | Hughes et al. | 339/17 LC |
| 4,367,908 | 1/1983 | Johnston | 339/176 M |

*Primary Examiner*—John McQuade
*Assistant Examiner*—Paula Austin

[57] ABSTRACT

A multiconnection electrical assembly employing a jack and complementary plug. The jack has cavities for receiving two inserts containing multiple spring wire conductors and a plug containing multiple insulated wires pierced by insulation displacement contacts. The assembly provides for electrically connecting the wires of the plug with the spring wires of the two inserts.

4 Claims, 5 Drawing Figures

JACK AND PLUG ELECTRICAL ASSEMBLY

DESCRIPTION

1. Technical Field

This invention relates to electrical assemblies. More specifically, it refers to an electrical assembly employing a jack and plug with electrical contact positions on two sides of the plug mating with two sets of electrical conductors in the jack.

2. Background Art

Jacks and plugs have found widespread acceptance in the telecommunications systems of the world because of their ease in connecting and disconnecting, low cost and reliable electrical connections. U.S. Pat. No. 3,850,497 describes the jacks in detail and U.S. Pat. No. 3,860,316 does likewise with the plugs. One of the limitations of the assembly of these jacks and plugs is that they have a limited number of electrical contact positions. Conventional jacks currently available commercially have up to twelve positions. Since these jacks and plugs are also useful in other electronic systems which require more positions, a need has now arisen for greatly increased electrical positions for each jack/plug assembly. The known jacks and plugs cannot satisfy the demand for more than twelve electrical contact positions.

SUMMARY OF THE INVENTION

I have solved the problem discussed above with a jack and plug assembly that more than doubles the positions available in known jacks and plugs.

My assembly employs a jack having three internal cavities. The central cavity extends from the front to the back of the jack housing and accommodates a complementary plug. The plug rides in a pair of guiderails located in each sidewall of the jack housing. On each side of the central cavity there is also an upper cavity and lower cavity respectively, each one defined by sidewalls, a front wall and a ceiling or floor, respectively, accommodating a pair of inserts.

The plug has a cord input end, an internal cavity within the plug housing enclosing multiple insulated wires from the cord, means for securing the cord within the plug housing and a conductor contact end opposite the cord-input end. The contact end has an upper and lower end, each containing multiple conductor receiving troughs formed within a portion of the cavity. Each trough accommodates one of the insulated wires. The plug also has a plurality of terminal receiving openings, each one communicating with a trough and the exterior of the plug. A conductive insulation piercing terminal is positioned within each terminal receiving opening with its first contact position engaging the conductive wire by piercing the insulation of the insulated wire in the trough and a second contact position facing the exterior of the plug and being available to electrically contact a spring wire conductor from a jack insert.

Each insert contains multiple channels, each channel retaining a single spring wire conductor. The ends of these conductors exit from one end of the insert and are bent back over the top of the insert so that the ends are available for electrical contact with a contact position on the plug.

BRIEF DESCRIPTION OF DRAWINGS

The present invention may be best understood by those of ordinary skill in the art by reference to the following detailed description when considered in conjunction with the accompanying drawings in which.

DESCRIPTION OF THE PREFERRED EMBODIMENT

Figure 1:
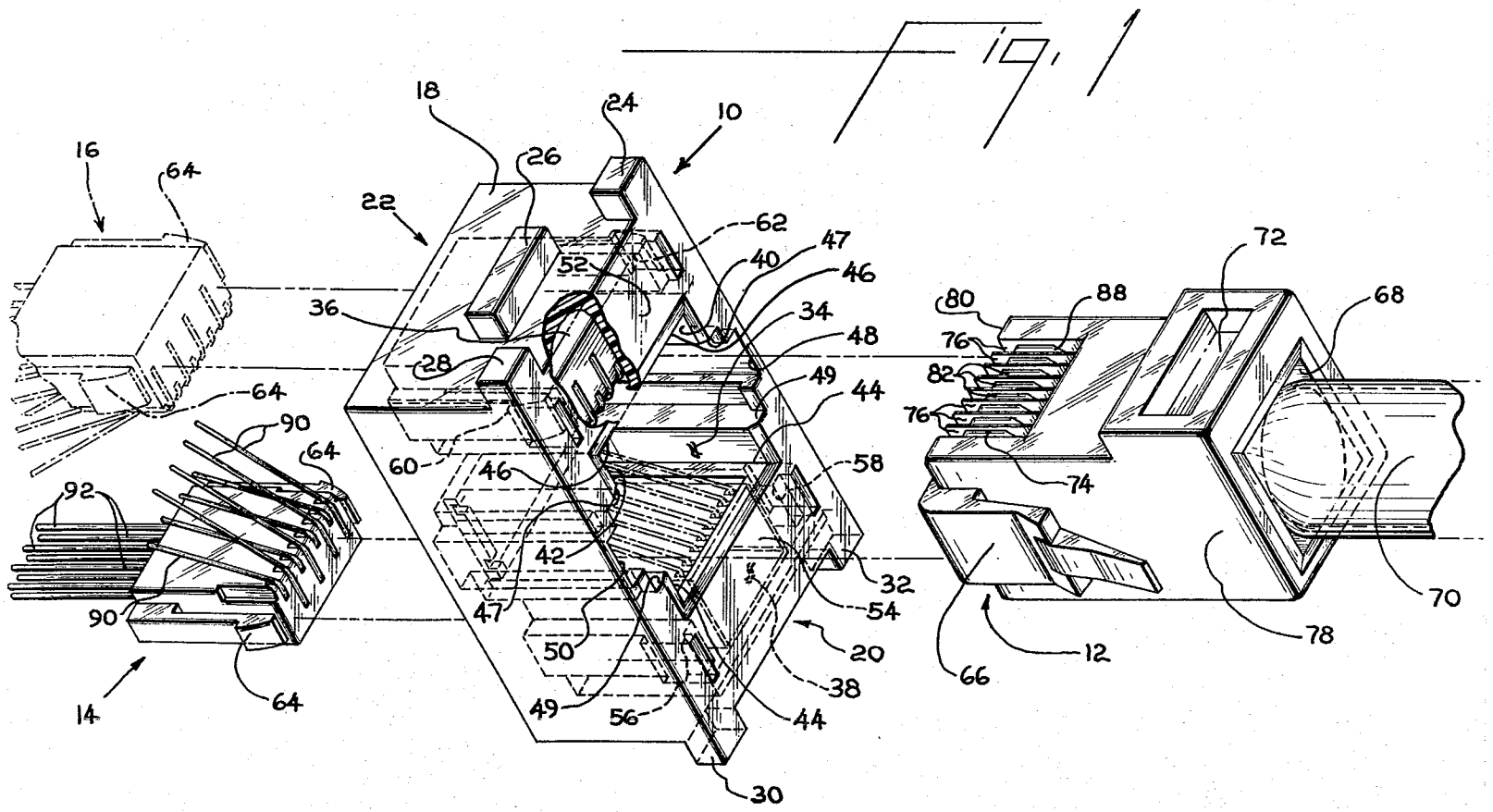
FIG. 1 is an exploded view of the electrical assembly parts showing the inserts, jack and plug before assembly. One insert shown in phantom outside the jack is also shown in a cut-away inserted within the jack. Conversely the other insert shown in phantom within the jack is also shown in its position prior to insertion into the jack.
Figure 2:
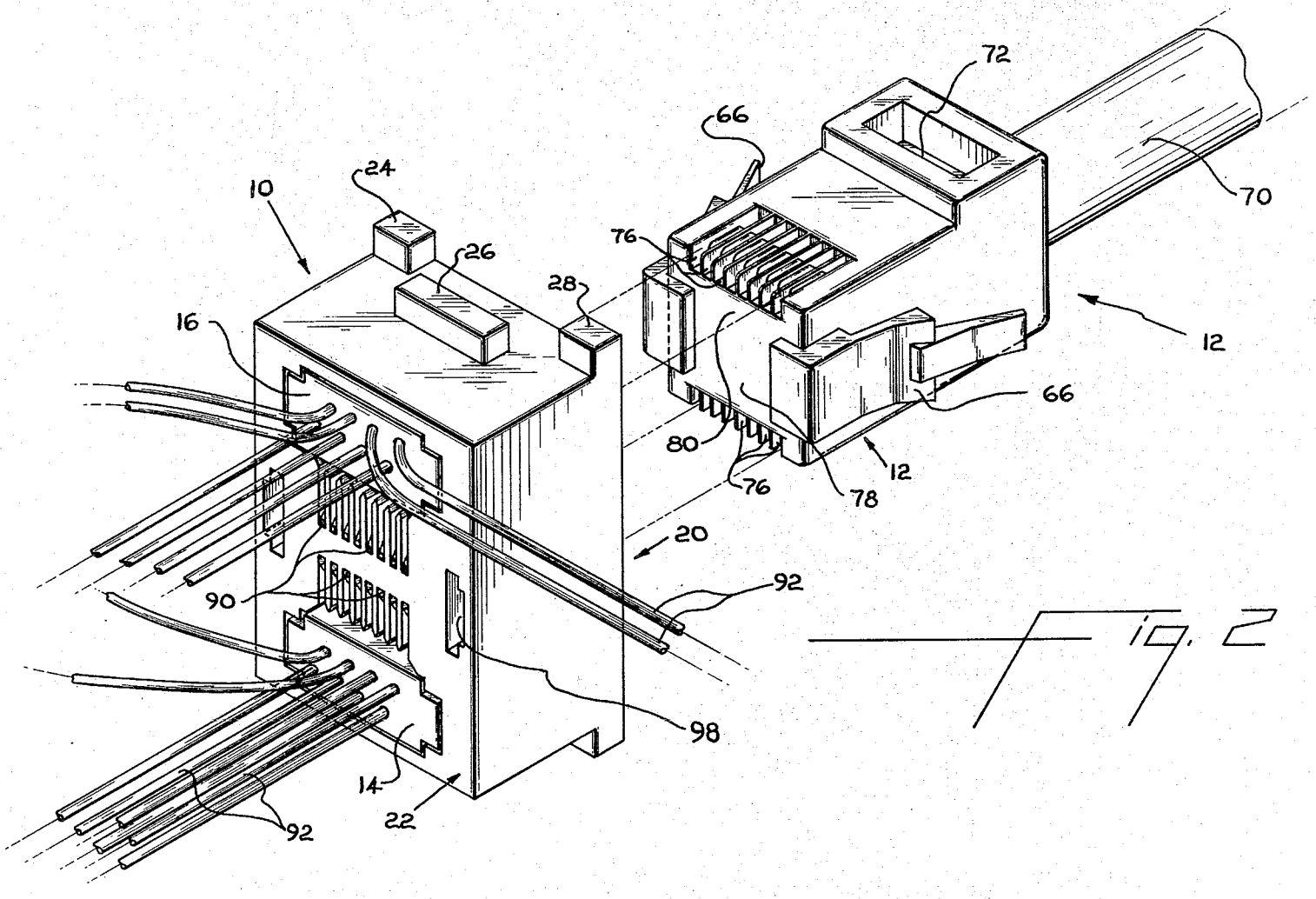
FIG. 2 is a perspective of the back portion of the jack with the two inserts in place. The plug is shown in perspective about to be inserted into the jack.
Figure 3:
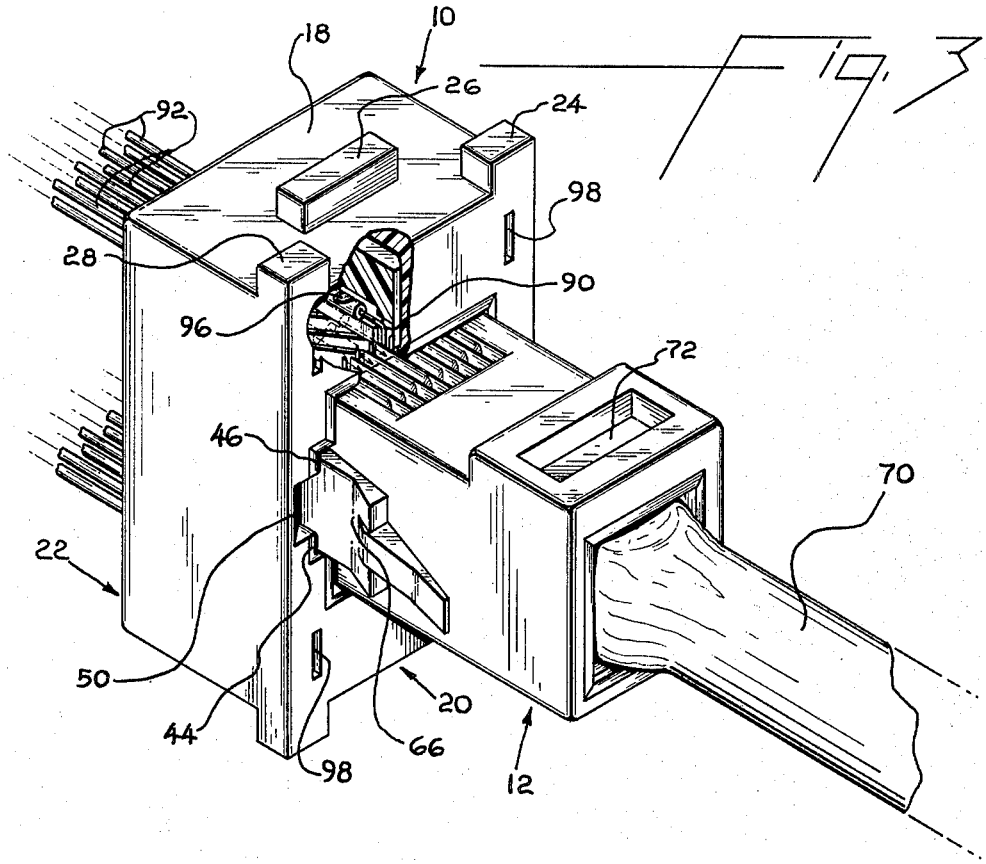
FIG. 3 is a perspective and partial cut-away of the jack front portion with the plug partially inserted.
Figure 4:
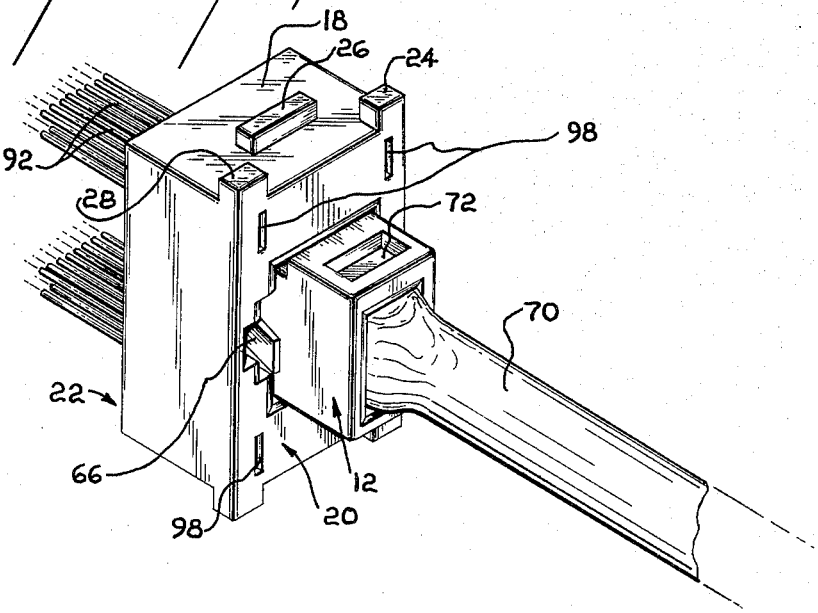
FIG. 4 is a perspective of the plug latched to the front portion of the jack.

Referring now to the drawings in which like reference characters designate like or corresponding parts throughout the several views, there is shown in FIG. 1 the multiconnection electrical assembly. The jack 10 has a dielectric housing 18 with a front portion 20 and a rear portion 22. Mounting ears 24, 26, 28, 30 and 32 are external projections of the dielectric housing 18 formed in the molding process.

The housing 18 has a central cavity 34, an upper cavity 36 and a lower cavity 38.

The central cavity 34 is defined by sidewalls 40 and 42. Each sidewall has identical guiderails 44 and 46 which accommodate the plug 12 when inserted into the jack 10. The sidewalls 40 and 42 each have a latch receptacle 48 and 50, respectively. Sidewalls 40 and 42 also contain latch receptacles 56, 58, 60 and 62 to accommodate the latches 64 on the inserts 14 and 16.

The front portion 20 of the dielectric housing 18 contains a partial front wall 52 and 54, to retain the upper insert 16 and the lower insert 14, respectively.

Figure 5:
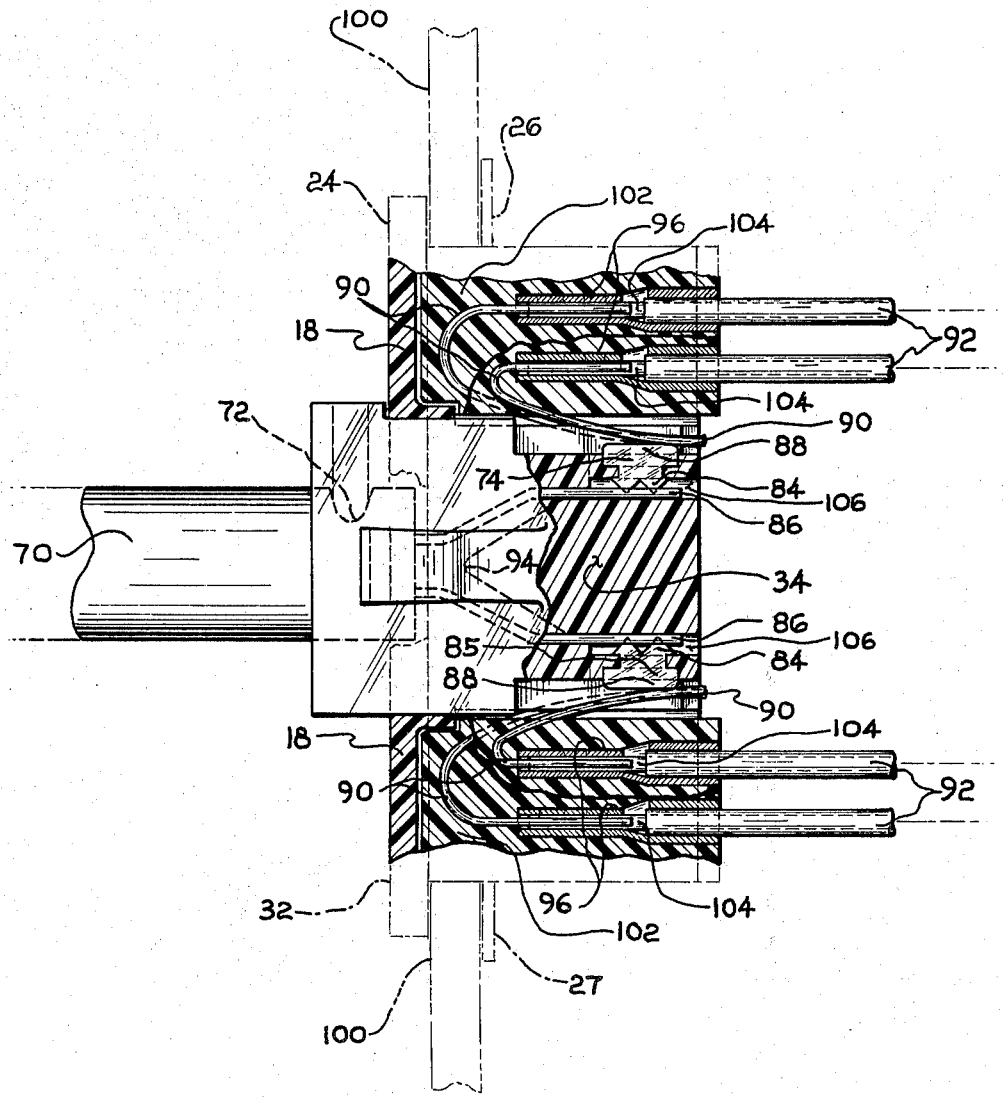
FIG. 5 is a cross section of the plug and jack assembled as shown in FIG. 4.

The plug 12 contains a dielectricl housing 78 with exterior latches 66. A cord input end 68 in the housing 78 receives a cord 70. The cord contains multiple insulated wires 86 as shown in FIG. 5. The plug also has a strain relief 72 which is obtained by deforming the plastic of the dielectric housing 78. The inside of the plug consists of a cavity 106 within which the insulated wires are positioned. Approximately half the wires 86 lead to the upper portion of the plug 12 and the other half to the lower portion. A divider 94 separates the conductive wires 86. The contact end 80 has an upper and lower end, each containing multiple conductor receiving troughs 76 which form a portion of the cavity 34 within the plug. Each trough 76 will contain one of the insulated wires 86. A plurality of terminal receiving openings 82 communicates with the trough. A conductive insulation piercing terminal 74 is positioned within each terminal receiving opening 82 with its first contact portion 84 engaging the conductive wire 86 in the trough 76 and a second contact portion 88 facing the exterior of the plug and being available to electrically contact the spring wire conductor 90 in both the upper insert 16 and the lower insert 14.

The plug 12 inserted into the front 20 of the jack 10 so that the latches 66 move within the latch receptacles 48 and 50 and the edges of the plug ride on the rails 44 and 46. The plug 12 fills the cavity 34 of the jack 10. The plug 12 can be removed from the jack 10 by pushing the ends of the latches 66 inwards, thus disengaging it from the latch receptacle 48 and 50. The latch rides on pairs of ledges 47 and 49. The second contact end 88 of the terminal 74 is exposed on both sides of the plug 12 to readily engage the conductive wires 90 from the upper and lower inserts 16 and 14, respectively.

The inserts 14 and 16 are identical, each having latches 64 on each side that ride in latch grooves 56, 58 in the jack 10. Each insert contains internal channels within its inner plastic body 102. An insulated wire 92 is stripped to expose its end 104 which is inserted into a channel within the insert and is crimped 96 to a conductive wire 90. The conductive wire is bent back over itself outside the insert body. The lower insert 14 is inserted into the lower cavity 38 of the jack 10 and the top insert 16 is inserted into the upper cavity 36 in the jack 10. Each insert is located within the jack 10 so that its conductive wires 90 are free within the cavity 34 of jack 10. After the inserts have been placed within the jack housing, the movement of the plug 12 into cavity 34 of jack housing 10 causes the conductive wires 90 to contact the terminal surfaces 88 and make an electrical connection with the plug 12.

Molding holes 98 in the jack housing 18 facilitates the making of internal cavities.

The conductive wires 90 are plated with gold or some other material resistant to oxidation. The wire itself can be copper or other conductive material. The jack housing, plug housing and insert housings can all be made of filled polyester or other dielectric plastic material.

This assembly can be used in the telecommunications industry for telephones or for contacts in computers, toys and other devices employing electrical connections.

Having thus described the invention what is claimed as new and desired to be secured by Letters Patent is:

1. A quick connect multiconnection electrical assembly employing a jack and complementary plug wherein the jack comprises:

(a) a dielectric housing having a front and back portion, (b) a central cavity within the housing defined by two sidewalls and extending from the front to the back portion of the housing, (c) a pair of guiderails in each sidewall accommodating the plug inserted into the front of the housing, (d) an upper cavity within the housing defined by two sidewalls, a front wall and a ceiling, said upper cavity accommodating an upper jack insert, (e) a lower cavity within the housing defined by two sidewalls, a front wall and a floor, said lower cavity accommodating a lower jack insert, (f) said upper and lower jack inserts having a dielectric structure of a size and shape complementary to the upper and lower cavities, respectively, and multiple internal channels each one accommodating a single spring wire conductor, each conductor exiting from an end of the structure and bent back over a top of the structure so that the conductors extend towards the central cavity to form terminal ends when the inserts are inserted into the upper and lower cavities from the back of the jack; and the plug comprises:

(a) a dielectric housing with a cord input end for receiving an end portion of a cord containing multiple insulated wires, internal surfaces of the plug housing defining a cavity enclosing the end portion of the multiple insulated wires, (b) means for securing the cord within the plug housing, (c) a conductor contact end opposite said cord-input end, the contact end having an upper and lower end, each containing multiple conductor receiving troughs formed in a portion of the cavity, each trough accommodating one of the insulated wires, (d) a plurality of terminal-receiving openings, each one communicating with a trough and the exterior of the plug, and (e) a conductive insulation piercing terminal positioned within each terminal receiving opening with its first contact portion engaging the conductive wire by piercing the insulation of the insulated wire in the trough and a second contact portion facing the exterior of the plug and being available to electrically contact a spring wire conductor from the jack insert.

2. The electrical assembly according to claim 1 wherein the plug has a latch on each side which engages a latch receptacle in each side wall of the jack central cavity.

3. The electrical assembly according to claim 2 wherein each latch rides on a pair of guide rails within each side wall of the jack central cavity.

4. The electrical assembly according to claim 1 wherein the upper and lower insert has side latches which ride within latch grooves within the side walls of said upper and lower jack cavity respectively.

* * * * *